US006315117B1

(12) United States Patent
Han

(10) Patent No.: US 6,315,117 B1
(45) **Date of Patent: *Nov. 13, 2001**

(54) GOLF BAG WITH SUPPORT STAND

(76) Inventor: Don Kyu Han, 1 Saros, Irvine, CA (US) 92612

( * ) Notice: Subject to any disclaimer, the term of this patent is extended or adjusted under 35 U.S.C. 154(b) by 0 days.

This patent is subject to a terminal disclaimer.

(21) Appl. No.: 09/359,408

(22) Filed: Jul. 22, 1999

Related U.S. Application Data

(63) Continuation-in-part of application No. 09/218,993, filed on Dec. 22, 1998, now Pat. No. 6,098,797.

(51) Int. Cl.[7] ..... A63B 55/00; A63B 55/06

(52) U.S. Cl. ..... 206/315.7; 206/315.3; 248/96

(58) Field of Search ..... 206/315.3, 315.7, 206/315.8; 248/96

(56) References Cited

U.S. PATENT DOCUMENTS

| | | | |
|---|---|---|---|
| 1,757,471 | 5/1930 | Platt | 248/96 |
| 2,430,107 | 11/1947 | Cronrath . | |
| 4,620,682 | 11/1986 | Yim | 248/96 |
| 4,834,235 | 5/1989 | Solheim et al. | 206/315.7 |
| 4,921,192 | 5/1990 | Jones | 248/96 |
| 5,152,483 | 10/1992 | Maeng | 206/315.7 X |
| 5,154,377 | 10/1992 | Suk | 206/315.7 X |
| 5,186,424 | 2/1993 | Shultz et al. | 248/179 |
| 5,209,350 | 5/1993 | Maeng | 206/315.7 |
| 5,340,063 | 8/1994 | Hsieh | 206/315.7 X |
| 5,415,285 | 5/1995 | Reimers | 206/315.7 |
| 5,464,180 | 11/1995 | Cheng | 206/315.7 X |
| 5,507,384 | 4/1996 | Maeng | 206/315.7 |
| 5,516,064 | 5/1996 | Hsieh | 248/96 |
| 5,549,263 | 8/1996 | Maeng | 206/315.7 X |
| 5,607,128 | 3/1997 | Suk | 206/315.7 |
| 5,762,189 | 6/1998 | Reimers | 206/315.7 |
| 5,799,786 | 9/1998 | Beck et al. | 206/315.7 |
| 5,996,789 * | 12/1999 | Suggs et al. | 206/315.7 X |
| 6,010,101 * | 1/2000 | Stein et al. | 206/315.7 X |
| 6,062,383 * | 5/2000 | Han | 206/315.7 |

* cited by examiner

*Primary Examiner*—Sue A. Weaver
(74) *Attorney, Agent, or Firm*—Lee & Hong

(57) ABSTRACT

A golf bag having a body and support legs pivotally attached to the body and actuated by an actuator rod which is partially hidden inside the body. The actuator rod is actuated by an actuator assembly comprising a base member and an actuator plate. When the bag is tilted, the actuator plate cooperates with the actuator rod to cause the legs to pivot away from the bag body to form a support for the bag. The actuator mechanism and the lower portion of the actuator shaft are located inside the golf bag body. The actuator assembly also includes a cover or a shutter for covering the base member and the actuator plate so the coupling of the actuator rod and the actuator plate is hidden from view.

18 Claims, 9 Drawing Sheets

10
12a
34
36
18
16a
40
20a
24a
24a
26
24b
16
20
12
12b
28
12c
16b

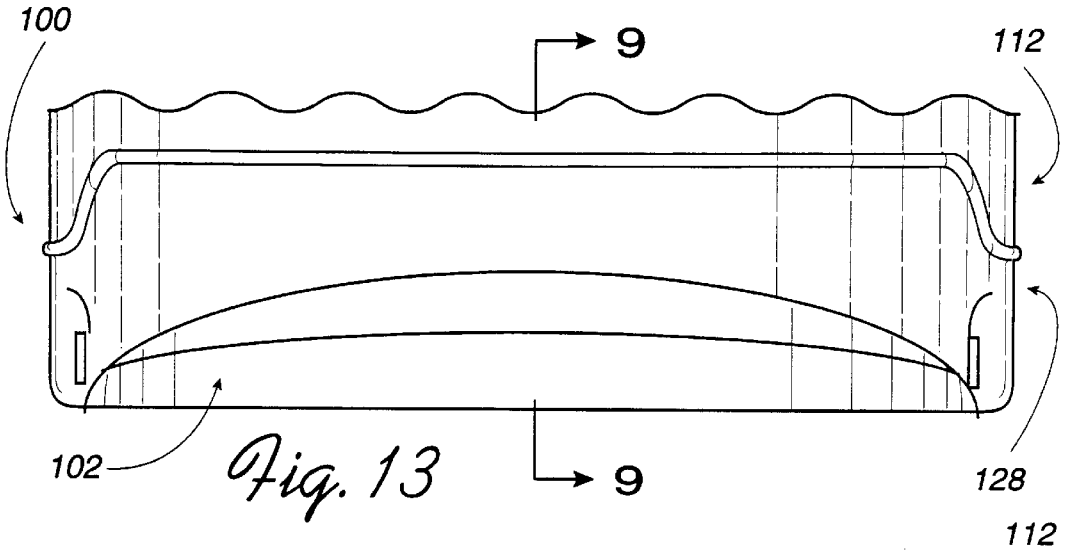
Fig. 13
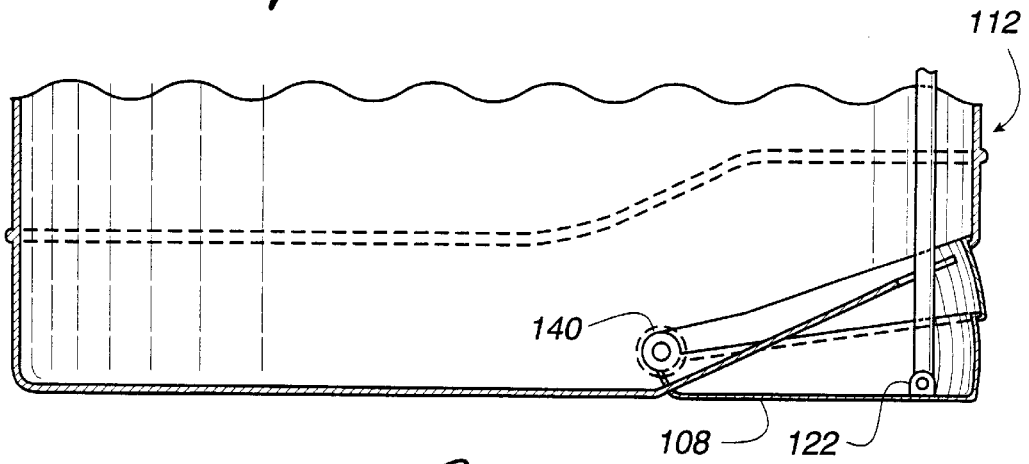
Fig. 14
Fig. 15
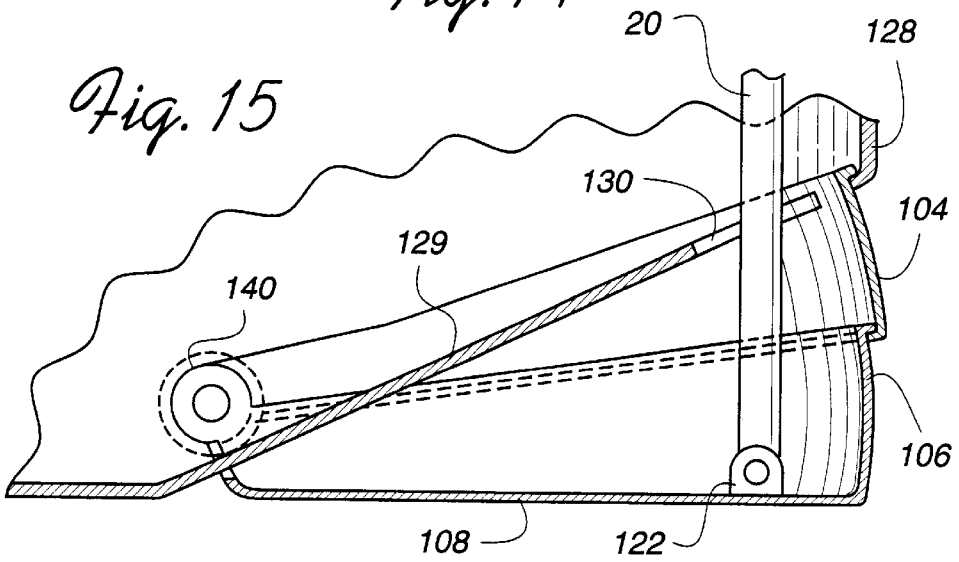

GOLF BAG WITH SUPPORT STAND

This is a continuation-in-part of application Ser. No. 09/218,993 filed on Dec. 22, 1998, now U.S. Pat. No. 6,098,797 which is fully incorporated herein by reference.

BACKGROUND OF THE INVENTION

1. Field of the Invention

This invention relates to golf bags, and more particularly to golf bags with extendable and retractable support stands which act in cooperation with an actuator mechanism to support the golf bag at an angle.

2. Description of Related Art

Golf is one of the most widely played sports activities in the United States. Not only is this activity already widespread, but the number of golfers continue to grow due to popularity of the sports caused by high stake games shown on television.

The sport of golf is typically played with a set of golf clubs which are commonly placed in a golf bag. When a golf bag is carried by a golfer, it is desirable to include a stand which supports the golf bag in its upright position to allow easy access to the golf clubs. Conventionally, this function has been accommodated by providing legs which are extendable when the golf bag is placed on the ground and retractable when the golf bag is carried.

Various methods have been used to move the legs between their retracted and extended positions. One method is described in U.S. Pat. No. 5,154,377 to Suk (the "Suk reference"). In the Suk reference, before a pair of legs can be used to support a golf bag, a slide member must be moved in a descending position along a two parallel groove track formed in a slide bracket.

When the extending feature of the legs are not needed, the user must then manually move the slide member in an upward position along the track. The manual operation of the sliding member may be cumbersome to some golfers.

Another conventional golf bag stand is described in U.S. Pat. No. 5,152,483 to Maeng (the "Maeng reference"). In the Maeng reference, the pair of legs extend away from the golf bag to provide support when the golf bag is forcefully tilted with respect to the ground. In such a position, the contact surface area of the golf bag with the ground is minimal, which comprises the tips of two legs and an edge of the golf bag, and thus possibly causing the golf bag to tip over when it is placed on a slope or irregular surface. In addition, a horizontal drive member pivotally mounted to a base of the golf bag in the Maeng reference must be sufficiently rigid and large to withstand the tilting force, because the drive member must provide all of the actuating force to the U-shaped actuating member.

In these prior golf bags, however, the mechanism that actuates the leg movements is disposed outside of the body of the golf bag and directly contact the ground. The actuator mechanism is therefore susceptible to damages and is esthetically unpleasant.

In addition, because the base plate that activates the actuator mechanism extends beyond the base of the golf bag, the base plate may damage equipment near the golf bag.

SUMMARY OF THE DISCLOSURE

It is an object of the present invention to provide a golf bag having support legs and an actuator mechanism which act in cooperation therewith that obviates one or more problems of the prior art.

It is a further object of the present invention to provide a golf bag having the actuator mechanism not protruding from the bag body and becoming an obstacle to other nearby equipment.

It is a further object of the present invention to provide a golf bag having the actuator mechanism which is aesthetically pleasing and prevents dirt and foreign substance from hindering its operation.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

According to one embodiment of the present invention, a golf bag includes a body having a side surface and a bottom end, the body defining a longitudinal axis; at least one leg pivotally connected to the body and being able to pivot between a retracted position where the leg is disposed substantially longitudinally along the side surface of the body and an extended position where lower end of the leg is spaced apart from the body; an actuator member disposed substantially longitudinally along the side surface of the body and longitudinally moveable relative to the body, the actuator member being connected at an upper portion to the leg so that the longitudinal motion of the actuator shaft effects the pivoting motion of the leg; a base member disposed at the bottom end of the body, the base member having a bottom face substantially perpendicular to the longitudinal axis of the body and a slanted face extending from the bottom face at an angle therewith to define a cutout region; an actuator plate pivotally connected to the base member, the actuator plate being able to pivot between a first position and a second position, wherein the lower end of actuator member is connected to the actuator plate so that the actuator shaft moves longitudinally when the actuator plate pivots between the first and the second position; and a shutter assembly slidably attached to the base member and to the actuator plate to at least partially enclose the cutout region defined by the base member.

According to one aspect of the present invention, the shutter assembly comprises at least two shutters slidably coupled to each other so that when the actuator plate at the second position the shutters are collapsed. The two shutters include a lower shutter and an upper shutter, wherein the lower shutter is integrally attached to the actuator plate. Preferably, the shutter assembly substantially enclose the cutout region defined by the base member. In addition, the shutters are substantially of a U-shape and are pivotally coupled to each other to share the same pivot hole. The shutters are made of either a non-transparent or a transparent material.

A According to another aspect of the present invention, a lower portion of the actuator member is partially hidden from view to engage the actuator plate. The actuator member is a U-shaped actuating rod, a bottom end of the actuating rod being connected to the actuator plate and a top end being pivotally connected to the leg.

The golf bag according to the present invention may be manufactured by providing a body having a side surface and a bottom end, the body defining a longitudinal axis; pivotally attaching at least one leg to the body and being able to pivot between a retracted position where the leg is disposed substantially longitudinally along the side surface of the body and an extended position where lower end of the leg is spaced apart from the body; providing an actuator member substantially longitudinally along the side surface of the body and longitudinally moveable relative to the body, the actuator member being connected at an upper portion to the leg so that the longitudinal motion of the actuator shaft effects the pivoting motion of the leg; providing a base member disposed at the bottom end of the body, the base member having a bottom face substantially perpendicular to the longitudinal axis of the body and a slanted face extending from the bottom face at an angle therewith to define a cutout region; pivotally connecting an actuator plate to the base member, the actuator plate being able to pivot between a first position and a second position, wherein the lower end of actuator member is connected to the actuator plate so that the actuator shaft moves longitudinally when the actuator plate pivots between the first and the second position; and attaching a shutter assembly to the base member and to the actuator plate to at least partially enclose the cutout region defined by the base member.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

FIG. 13 is a front elevation view of the bottom portion of the golf bag according to a second embodiment of the present invention;

FIG. 14 is a partial sectional view showing the bottom portion of the golf bag of FIG. 13 when the golf bag is in the upright position;

FIG. 15 is an exploded view showing the collapsible shutter assembly of FIG. 13;

DETAILED DESCRIPTION OF THE PREFERRED EMBODIMENTS

Figure 1:
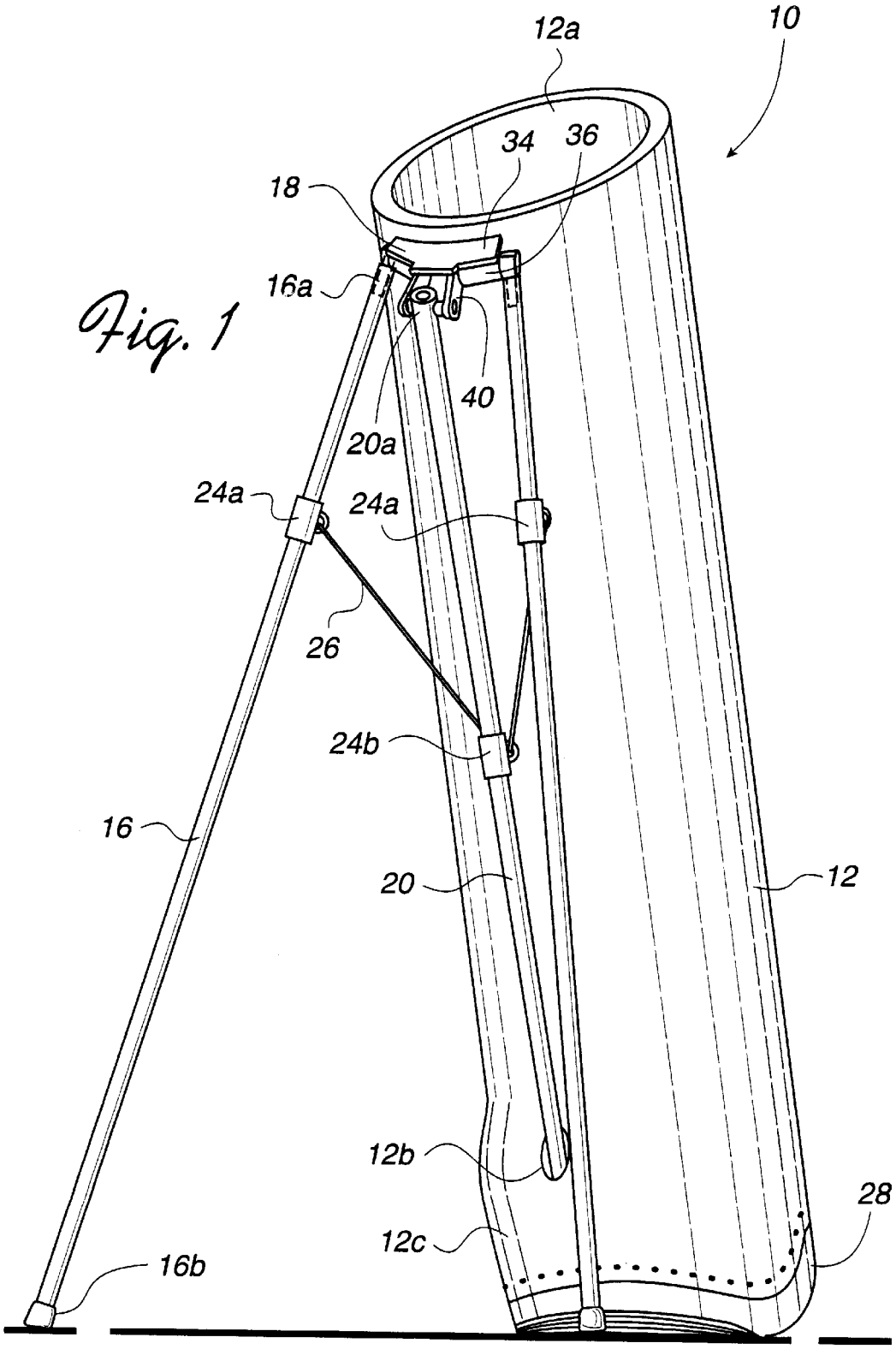
FIG. 1 is a perspective view of a golf bag according to an embodiment of the present invention.
Figure 2:
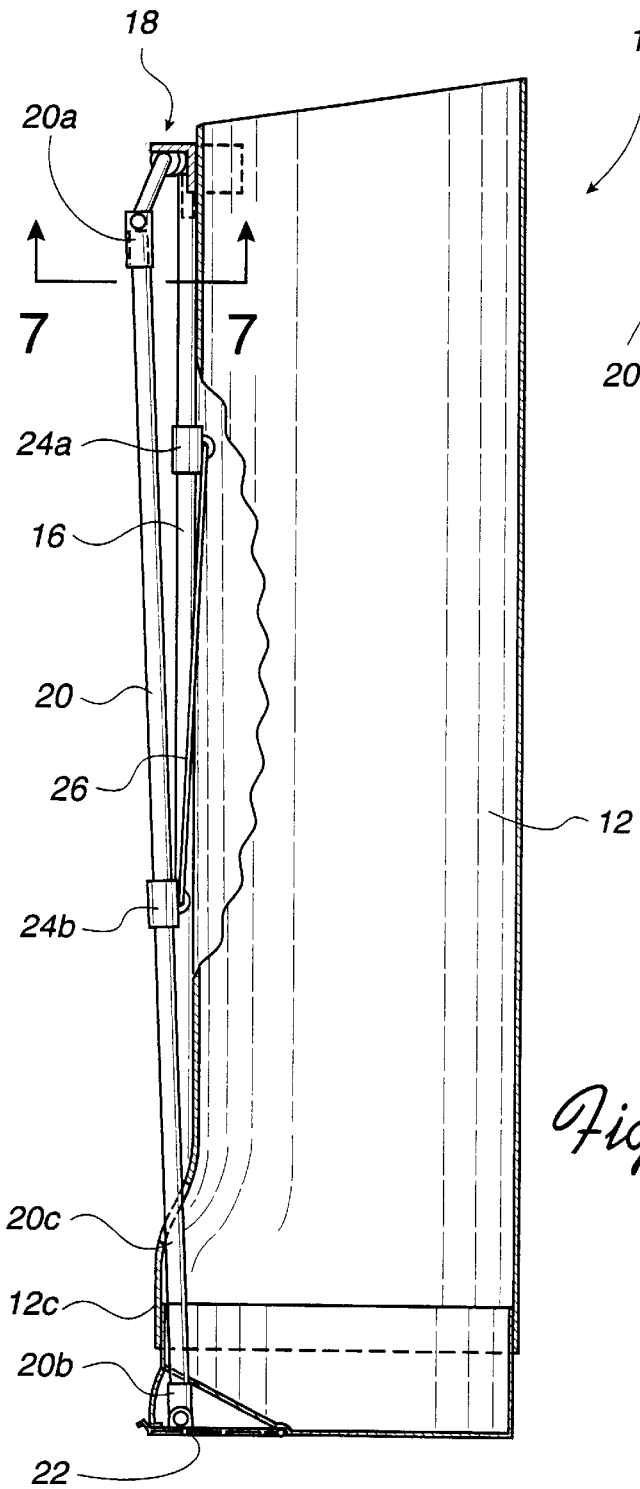
FIG. 2 is a partial sectional view showing the golf bag of FIG. 1 in an upright position with the legs in a retracted position.
Figure 3:
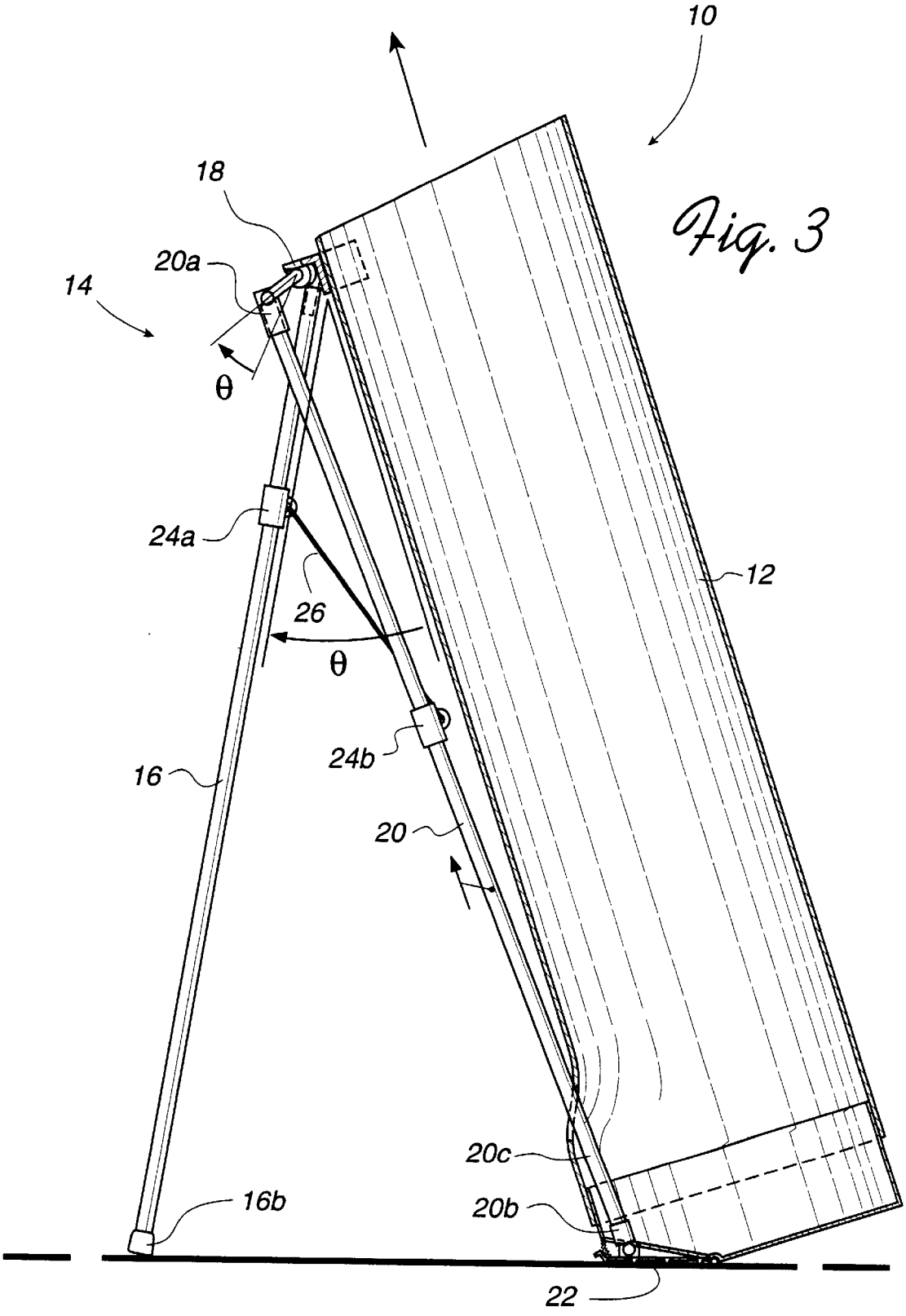
FIG. 3 is a partial sectional view showing the golf bag of FIG. 1 in an extended or leaning position with the legs in an extended position.

A golf bag with a support stand according to an embodiment of the invention is shown in the drawings for purposes of illustration. Referring to FIGS. 1–3, there is shown a golf bag 10 having a bag body 12 and a support stand assembly 14. The bag body 12, which is tubular in shape and has an opening 12*a* at the top, is preferably made of a rigid material such as plastic or other suitable material known to one of ordinary skill in the art and may be covered with a fabric material. The support stand assembly 14 includes two legs 16, the upper ends 16*a* of which are pivotally attached to an attachment assembly 18, which is in turn fixed to the bag body 12, preferably near the opening 12*a* of the bag body 12. The legs 16 may pivot between a retracted position and an extended position. In the retracted position, as shown in FIG. 2, the entire legs 16 are rested along the bag body 12 near an outer surface thereof. In the extended position, as shown in FIGS. 1 and 3, the legs 16 are positioned at an angle θ, preferably between about 20–50 degrees, with respect to an longitudinal axis A of the bag body 12, and the lower ends 16*b* of the legs are spaced apart from the bag body 12. When in the extended position, the lower ends 16*b* of the legs and a bottom portion of the golf bag may contact the ground so that the golf bag stands on the ground in a self-supported and leaning manner.

The pivoting of the legs 16 between the retracted and extended positions is actuated by an actuating mechanism which comprises an actuator shaft 20 extending substantially longitudinally along the bag body 12, and an actuator plate 22 (shown in FIG. 2) located near the bottom of the golf bag. The upper end 20*a* of the actuator shaft 20 is pivotally attached to the attachment assembly 18, and the lower end 20*b* of the shaft 20 is pivotally attached to the actuator plate 22. The shaft 20 is also connected to each of the legs 16 by three tubular members 24*a* and 24*b* mounted on a middle portion of each of the legs 16 and the shaft 20, and thin linking members 26, such as flexible rod or wire, connecting the tubular members 24*a* and 24*b*. The tubular members 24*a* and 24*b* may be slidable along the legs 16 and the actuator shaft 20, or may be fixed thereon. When pushed up at the lower end 20*b* by the actuator plate 22, the actuator shaft 20 moves upwards in a substantially longitudinal direction along the length of the bag body 12 and, through the attachment assembly 18, causes the legs 16 to pivot to their extended position.

Figure 7:
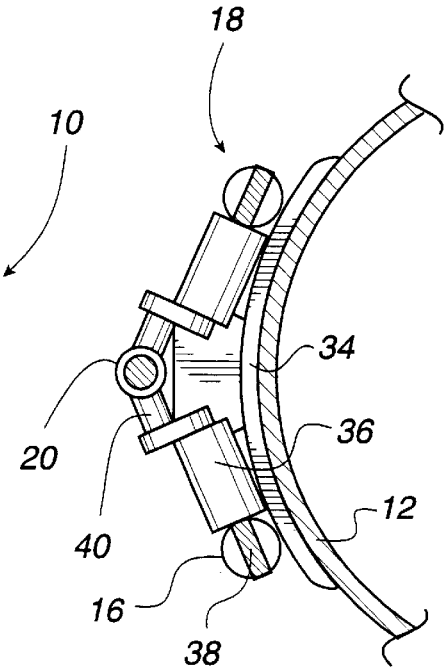
FIG. 7 is a top view of the attachment assembly for the legs and the actuator shaft.

The attachment assembly 18 is described in more detail with reference to FIG. 7 (a top view) as well as FIG. 1. Two tubular members 36 are mounted to the side surface of the bag body 12 via a curved mounting member 34, and a short shaft 38 is inserted through each tubular member 36. Each of the legs 16 is attached perpendicularly to one end of the short shaft 38, and the actuator shaft 20 is attached through an L-shaped member 40 to the other ends of the short shafts 38. The L-shaped member 40 and the legs 16 rotate around the short shaft in a fixed angular relationship. As a result, when the actuator shaft 20 is pushed up, the L-shaped member 40 is rotated, causing the legs 16 to rotate away from the bag body 12.

The major portion of the actuator shaft 20 is located outside of the bag body 12, but the lower part 20*c* of the actuator shaft 20 is hidden inside the bag body. A hole 12*b* on the bag body 12 is provided for this purpose. In addition, the bag body 12 has a bulging part 12*c* to accommodate the lower part 20*c* of the actuator shaft 20.

Figure 4:
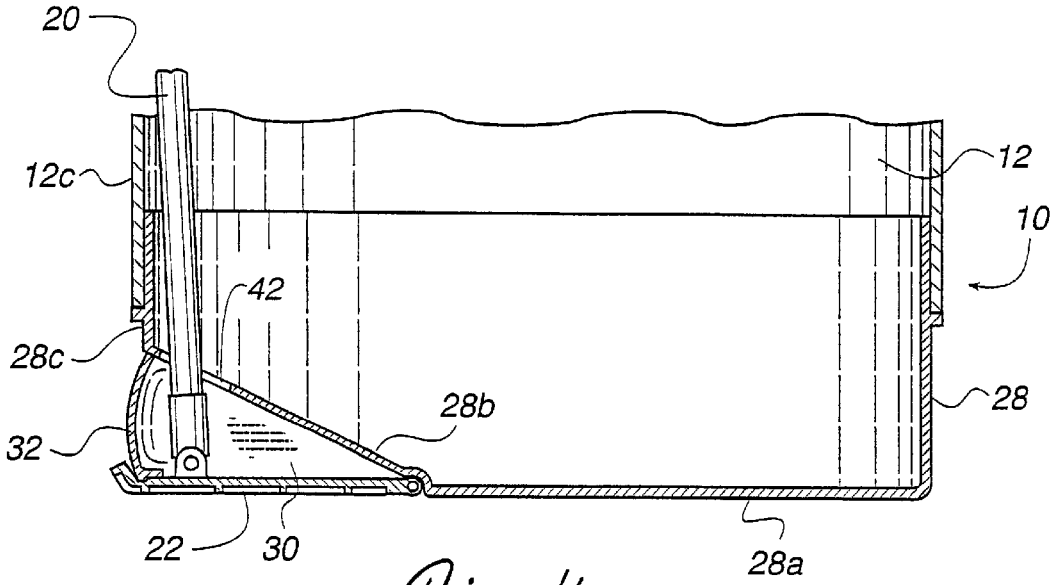
FIG. 4 is a partial sectional view showing the bottom portion of the golf bag of FIG. 1 when the golf bag is in the upright position.
Figure 5:
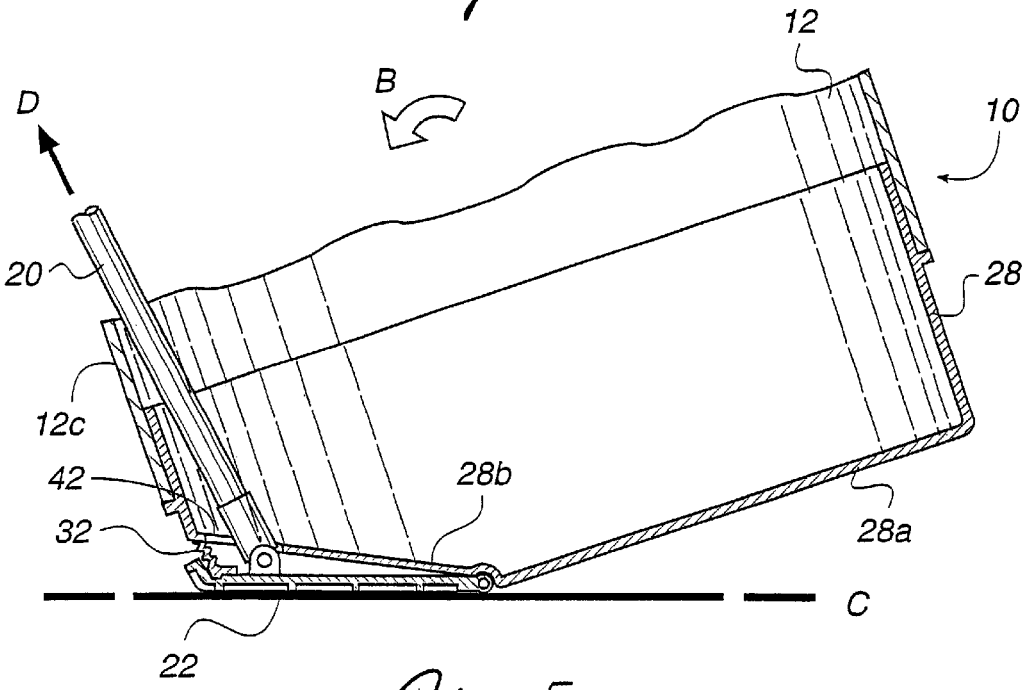
FIG. 5 is a partial sectional view showing the bottom portion of the golf bag of FIG. 1 when the golf bag is in the leaning position.

The actuator shaft 20 and plate 22 are described in more detail with reference to FIGS. 4, 5 and 6A–6C. As shown in FIGS. 4 and 5, disposed at the bottom of the bag body 12 is a rigid base member 28 which is mounted in a fixed relation with the other portions of the bag body 12. The base member 28, which preferably has a shape similar to a lateral cross-section of the bag body 12, has a bottom face 28*a* substantially perpendicular to the longitudinal axis and a slanted face 28*b*, where the slant face and the plane of the bottom face 28*a* defines a wedge-shaped cutout region 30 under the base member. The base member 28 is preferably made using an injection mold process or other suitable process known to one of ordinary skill in the art. The base member 28 is coupled to the bag body 12 and supports the weight of golf clubs placed therein. The base member 28 may be a solid or a hollow member.

Figure 6A:
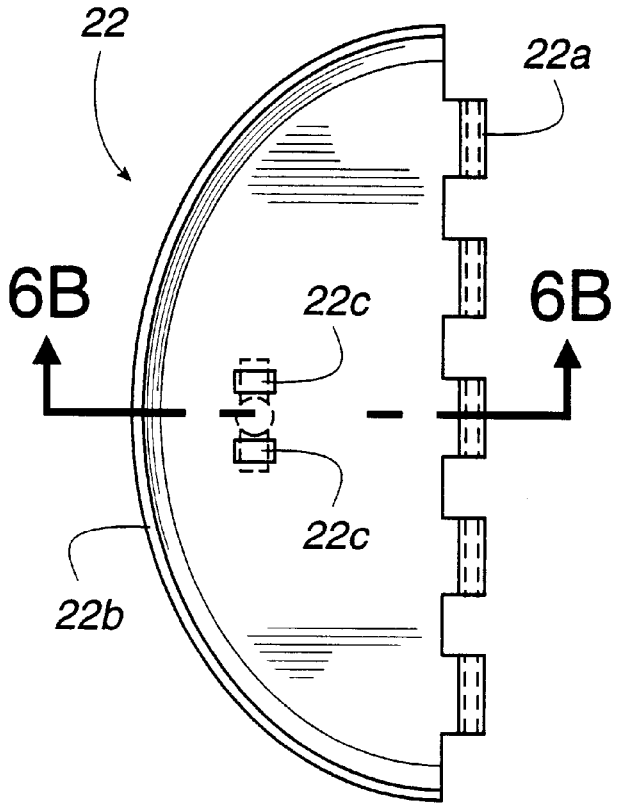
FIG. 6A is a plan view of the actuator plate according to an embodiment of the present invention.

The actuator plate 22 has a substantially straight edge 22*a* and a curved edge 22*b* as shown in FIG. 6A. The actuator plate 22 is pivotally connected at the straight edge 22*a* to the base member 28. The curved edge 22*b* of the actuator plate 22 substantially conforms to the contour or cross-sectional shape of the bag body 12 and to the membrane 32. The lower portion of the actuator shaft 20 extends longitudinally through a hole 42 formed in the slanted face 28*b* of the base member 28. The end 20*b* of the actuator shaft 20 is pivotally connected to the actuator plate 22 at a location near the curved edge 22*b* via, for example, a pair of bolts 22*c* or pins.

As shown in FIG. 4, a membrane 32 is provided to enclose the wedge-shaped cutout region 30. The membrane 32 is connected to the actuator plate 22 near the curved edge 22*b* thereof, and connected to the base member 28 at the lower end of a side face 28*c* thereof above the cutout region 30. Depending on the thickness and the material of the membrane 32, the bag 10 may require more or less force to tilt to compress the membrane 32. The membrane 32 may also be made of a transparent material to expose the pivoting mechanism of the actuator shaft 20 with the actuator plate 22. The membrane 32 is preferably attached to completely enclose or to cover the wedge-shaped cutout region 30. The attachment of the membrane 32 may be carried out by stitching, heat pressing, adhesives or other suitable process known to one of ordinary skill in the art.

The membrane 32 is preferably formed of a flexible and resilient material, such as rubber, silicon compound or the like. The membrane 32 may also be made of fabric or cloth materials. The membrane 32 may have air holes or contain printed designs for purposes of advertisement. The entire lower portion of the golf bag, including the base member 28, shown in FIGS. 4 and 5, may preferably be covered by a fabric cover (not shown).

The actuator plate 22 pivots with respect to the base member 28 to actuate the operation of the support stand assembly. As shown in FIGS. 2 and 4, when the golf bag 10 is standing in the upright position, the actuator plate 22 is located substantially in the plane of the bottom face 28*a* of the base member 28, so that both the bottom face 28*a* and the actuator plate are at a level with the ground. In this position, the actuator shaft 20 is not pushed up, so that the legs 16 assume their retracted position. In addition, when the actuator plate 22 is in the plane of the bottom face 28*a*, the resilient membrane 32 is in an expanded, undeformed or relatively less deformed state.

As shown in FIGS. 3 and 5, when the bag 10, which is standing upright on the ground, is tilted as indicated by arrow B, the actuator plate 22 is pressed against the ground (indicated by line C) to pivot toward the slanted face 28*b* of the base member 28. This pushes the actuator shaft 20 longitudinally upwards as shown by arrow D, which causes the legs 16 to pivot away from the bag body 12 to assume their extended position. As a result, the extended legs 16 and the actuator plate 22 form support points for the golf bag 10 so that the bag stands on the ground in a self-supported, leaning manner.

In addition, in the position shown in FIG. 5 where the actuator plate 22 is pivoted toward the slanted face 28*b* of the base member 28, the membrane 32 is in a compressed state. Compared with the expanded state as shown in FIG. 4, the compressed state is in a deformed or more deformed state. The membrane 32 therefore tends to urge the actuator plate 22 to pivot back into the plane of the bottom face 28*a* as shown in FIG. 4, which corresponds to the retracted position of the legs 16. For this reason, this is also the position assumed when the bag is carried or laid sideways on the ground.

Figure 8:
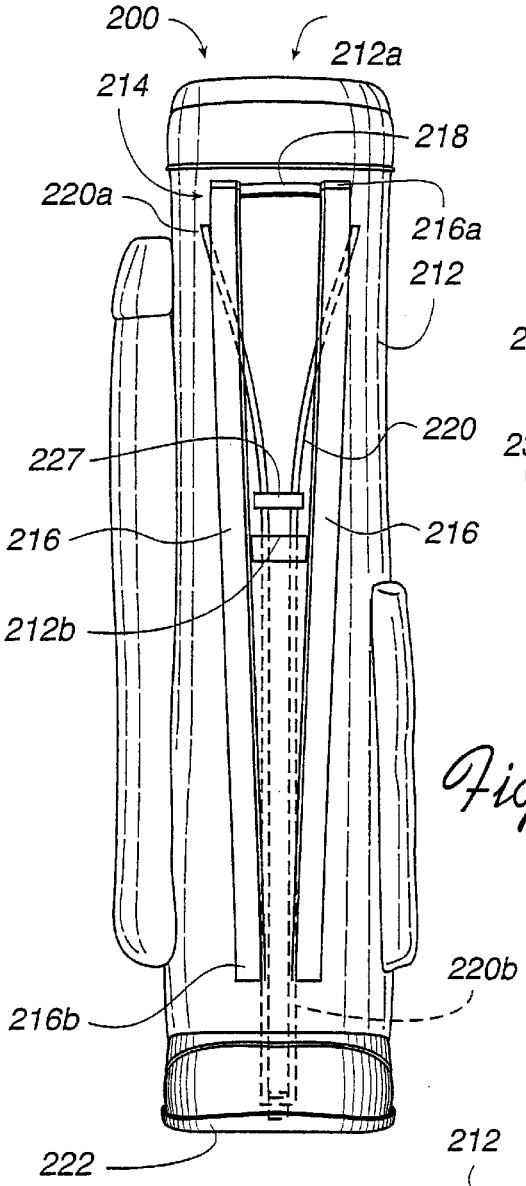
FIG. 8 is a front perspective view of the golf bag having an alternative support stand assembly.

FIG. 8 is a front perspective view of a golf bag 200 having an alternative support stand assembly. The golf bag 200 is similar to that of the first embodiment shown in FIG. 1, except that the golf bag 200 has a different support stand assembly 214 and a slightly differently configured bag body 212. The bag body 212, which is tubular in shape and has an opening 212*a* at the top, is preferably made of a rigid material such as plastic or other suitable material known to one of ordinary skill in the art and may be covered with a fabric material. The support stand assembly 214 includes two legs 216, the upper ends 216*a* of which are pivotally attached to an attachment assembly 218, which is in turn fixed to the bag body 212, preferably near the opening 212*a* of the bag body 212.

Figure 11:
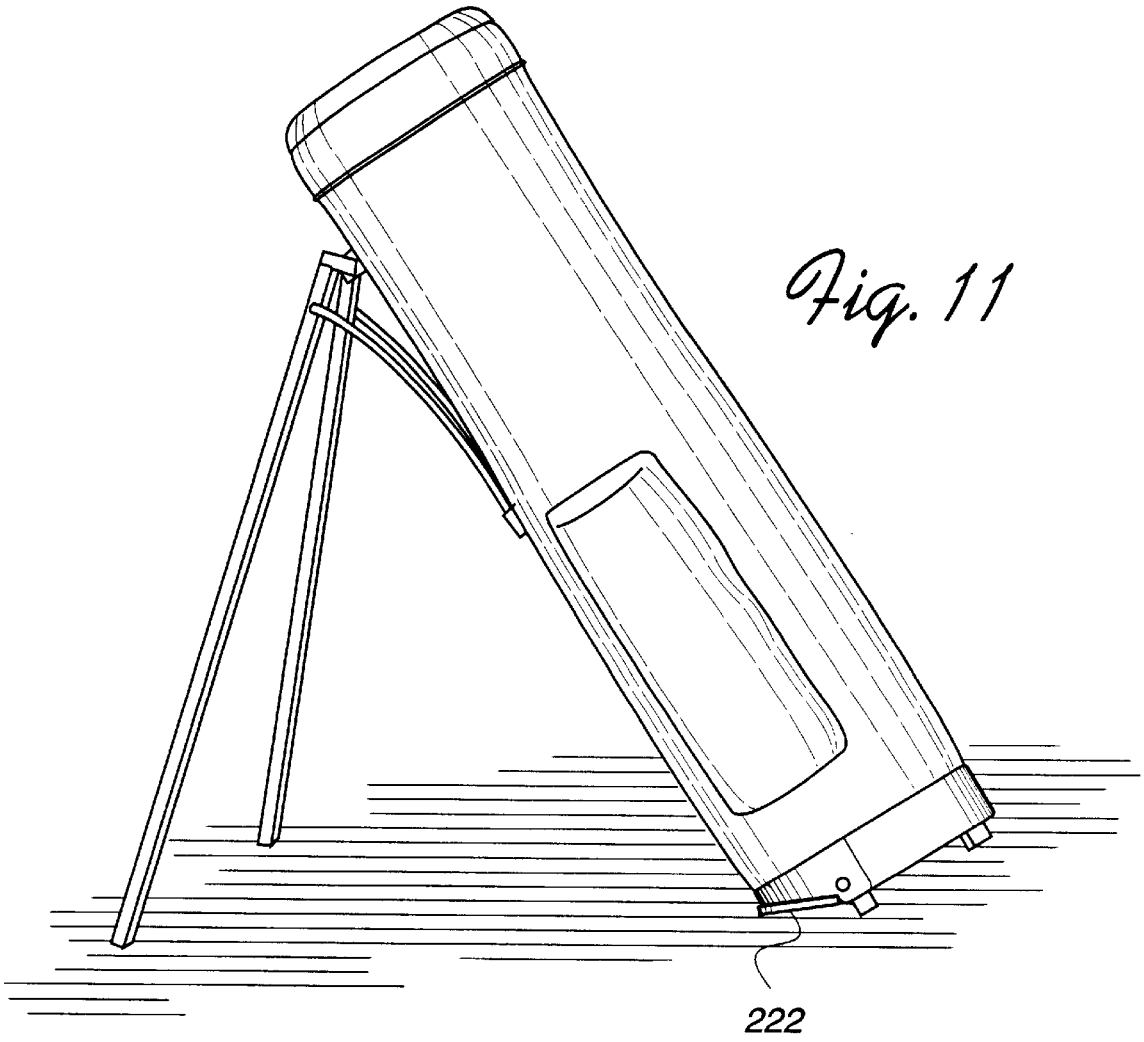
FIG. 11 is a side perspective view of the golf bag of FIG. 8.

The legs 216 may pivot between a retracted position, which is shown in FIG. 8, and an extended position, which is shown in FIG. 11. In the retracted position, as shown in FIG. 8, the entire legs 216 are rested along the bag body 212 near an outer surface thereof. In the extended position, as shown in FIG. 11, the legs 216 are positioned at an angle, preferably between about 20–50 degrees, with respect to an longitudinal axis of the bag body 12, and the lower ends 216*b* of the legs 216 are spaced apart from the bag body 212. When in the extended position, the lower ends 216*b* of the legs and a bottom portion of the golf bag 200 may contact the ground so that the golf bag stands on the ground in a self-supported and leaning manner.

The pivoting of the legs 216 between the retracted and extended positions is actuated by an actuating mechanism which comprises an actuator rod or member 220 extending substantially longitudinally along the bag body 212, and an actuator plate 222 located near the bottom of the golf bag 200. Each upper end 220*a* of the actuator rod 220 is pivotally attached to the upper portion of each corresponding leg 216, and the lower end 220*b* of the actuator rod 220 is pivotally attached to the actuator plate 222. In particular, the upper ends 220*a* of the actuator rod are pivotally connected to the legs 216 from the outer side of the legs 216, as better illustrated in FIG. 11. The actuator rod 220 is also equipped with a bracket 227 to hold and bias each strand of the actuator rod 220. The bracket 227 prevents the actuator rod 220 from spreading apart.

Figure 12:
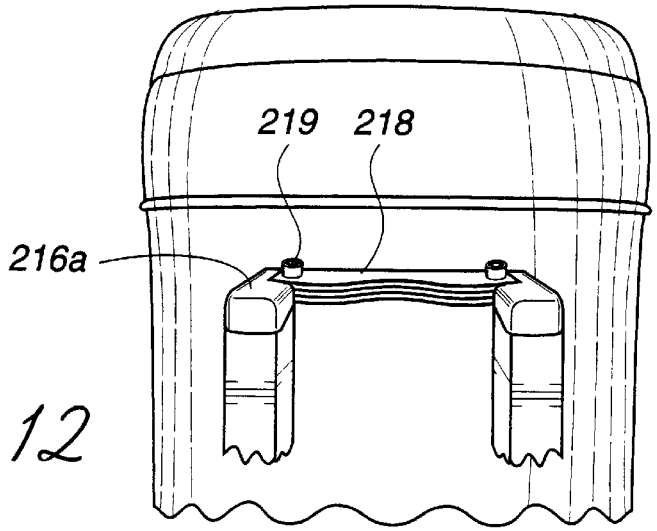
FIG. 12 is a view of an attachment assembly for the legs shown in FIG. 8.

The attachment assembly 218 is described in more detail with reference to FIG. 12. The legs 216 are connected to the attachment assembly 218 using any suitable pivoting device, such as a pin, shaft or bolt, known to one of ordinary skill in the art. Each of the legs 216 is attached preferably perpendicularly to the opposite end of the attachment assembly 218. The attachment assembly 218 also has a stopper 219 protruding at each end thereof which restricts and limits the outward extension of the legs 216.

In the second embodiment of the present invention, the major portion of the actuator rod 220 is located outside of the bag body 212, but the lower part 220*b* of the actuator rod 220 is hidden inside the bag body. A hole 212*b* or slit on the bag body 212 is provided for this purpose. Unlike the bag body of the golf bag shown in FIG. 1, the bag body 212 shown in FIG. 8 does not have a bulging part 12*c* at the lower end thereof. Instead, the hole 212*b* extends through the actuator plate 222 to accommodate the actuator rod 220.

The actuator rod 220 and plate 222 are described in more detail with reference to FIGS. 9 and 10. The actuator rod 220 has a substantially U-shaped configuration and is made of any suitable resilient material, such as metal and plastic, known to one of ordinary skill in the art. The actuator rod 220 preferably extends from the upper portion of the legs 216 to the actuator plate 222.

Figure 9:
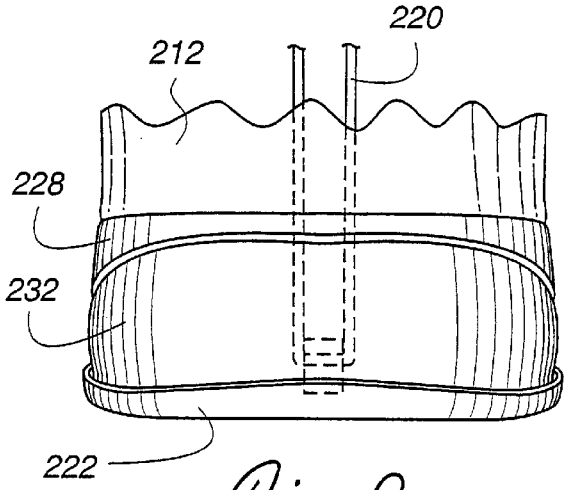
FIG. 9 is an enlarged view of the base of the golf bag of FIG. 8.
Figure 10:
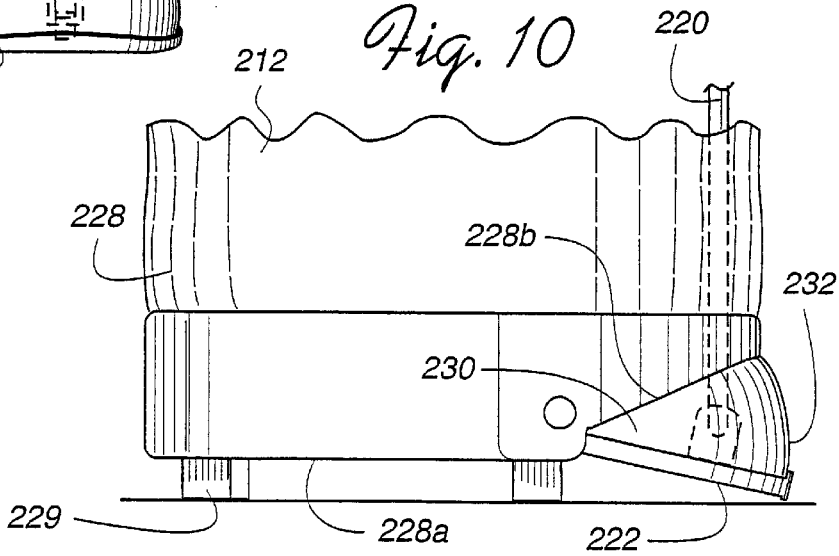
FIG. 10 is a right elevational view of the golf bag of FIG. 8.

As shown in FIGS. 9 and 10, disposed at the bottom of the bag body 212 is a rigid base member 228 which is mounted in a fixed relation with the other portions of the bag body 212. The base member 228, which preferably has a shape similar to a lateral cross-section of the bag body 212, a bottom face 228*a* substantially perpendicular to the longitudinal axis of the bag body 212 and a slanted face 228*b*, where the slant face and the plane of the bottom face 228*a* defines a wedge-shaped cutout region 230 under the base member. The base member 228 is preferably made using an injection mold process or other suitable process known to one of ordinary skill in the art. The base member 228 is coupled to the bag body 12 and supports the weight of golf clubs placed therein. The base member 228 may be a solid or a hollow member.

Figure 6B:
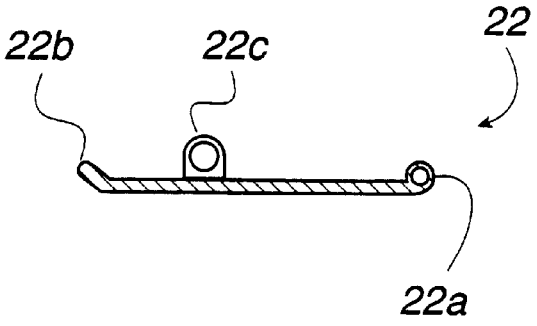
FIG. 6B is an elevation view of the actuator plate of FIG. 6A along line 6—6.

The actuator plate 222 has substantially the same shape as the actuator plate 22 shown in FIGS. 6A and 6B, and thus, its description will not be repeated. The actuator plate 222 is pivotally connected at the straight edge of the base member 28.

As shown in FIGS. 9 and 10, a flexible membrane 232 is provided to enclose the wedge-shaped cutout region 230. A lower end of the membrane 232 is preferably connected to the actuator plate 222 and an upper end is connected to the underside of the base member 228. Depending on the thickness and the material of the membrane 232, the golf bag 200 may require more or less force to tilt to compress the membrane 232. The membrane 232 may also be made of a transparent material to expose the pivoting mechanism of the actuator rod 220 with the actuator plate 222. The membrane 232 is preferably attached to completely or partially enclose or to cover the wedge-shaped cutout region 230. The attachment of the membrane 232 may be carried out by stitching, heat pressing, adhesives or other suitable process known to one of ordinary skill in the art.

The membrane 232 is preferably formed of a flexible and resilient material, such as rubber, silicon compound or the like. The membrane 232 may also be made of fabric or cloth materials. The membrane 232 may have air holes or contain printed designs for purposes of advertisement. The entire lower portion of the golf bag 200 including the base member 228, as shown in FIGS. 9 and 10, may preferably be covered by a fabric cover (not shown). The membrane 232 may also be made with an accordion like material to enhance collapsing of the membrane 232 when the golf bag 200 is tilted toward the ground.

The operation of the golf bag 200 shown in FIG. 8 is substantially identical to that of FIG. 1. The actuator plate 222 pivots with respect to the base member 228 to actuate the operation of the support stand assembly 214. As shown in FIG. 8, when the golf bag 200 is standing in the upright position, the actuator plate 222 is located substantially in the plane of the bottom face 228*a* of the base member 228 or lower if the base member 228 is supported by rubber feet 229, so that both the bottom face 228*a* and the actuator plate are at a level with the ground. In this position, the actuator rod 220 is not pushed up, so that the legs 216 assume their retracted position. In addition, when the actuator plate 222 is in the plane of the bottom face 228*a*, the resilient membrane 232 is in an expanded, undeformed or relatively less deformed state.

As shown in FIG. 11, when the golf bag 200, which is standing upright on the ground, is tilted, the actuator plate 222 is pressed against the ground to pivot toward the slanted face 228*b* of the base member 228. This pushes the actuator rod 220 longitudinally upwards, which causes the legs 216 to pivot away from the bag body 212 to assume their extended position. As a result, the extended legs 216 and the actuator plate 222 form support points for the golf bag 10 so that the bag stands on the ground in a self-supported, leaning manner.

In addition, in the position shown in FIG. 11 where the actuator plate 222 is pivoted toward the slanted face 228*b* of the base member 228, the membrane 232 is in a compressed state. Compared with the expanded state as shown in FIG. 10, the compressed state is a deformed or more deformed state. Depending on the material being used for the membrane 232, the membrane 232 tends to urge the actuator plate 222 to pivot back into the plane of the bottom face 228*a* as shown in FIG. 8, which corresponds to the retracted position of the legs 216. For this reason, this is also the position assumed when the bag is carried or laid sideways on the ground.

FIGS. 13–17 illustrate the golf bag according to a second embodiment of the present invention. In particular, FIGS. 13–17 illustrate a second embodiment of the base portion of the golf bag using a collapsible or slidable shutter assembly. Referring to FIG. 13, the golf bag according to the second embodiment has a substantially identical structure as that of the golf bags shown in FIGS. 1 and 8, except for the actuating plate and the membrane. In the second embodiment, a flexible membrane of the first embodiment, shown in FIGS. 1 and 8, is substituted with a collapsible shutter assembly 102 which is pivotally attached to the base member 128. The base member 128 is in turn coupled to the bag body 112 using any suitable method, such as fasteners, adhesives, stitches, etc. A slant face portion 129 of the base member 128 defines a hole 130 for receiving an actuating shaft 20 or an actuating rod 220 shown in FIGS. 1 and 8, respectively.

FIGS. 14 and 15 are partial sectional views showing the bottom portion of the golf bag of FIG. 13 when the golf bag is in the upright position. The collapsible shutter assembly 102 preferably includes a lower shutter portion 106 and an upper shutter portion 104 which are engagingly coupled to each other. Particularly, the upper edge line of the lower shutter portion 106 is coupled with the lower edge line of the upper shutter portion 104. Similarly, the upper edge line of the upper shutter portion 104 is coupled with the lower edge line of the base member 128. The coupling of the base member 128 to the upper and lower shutter portions 104 and 106 prevents these components from being disengaged from each other. The curvature radius of the lower shutter portion 106 is slightly smaller than that of the upper shutter portion 104 so that the lower shutter portion 106 is arranged to abut against the inner surface of the upper shutter portion 104. Both the upper and lower shutter portions 104 and 106 are pivotally connected to a pivot hole 140 of the base member 128.

Preferably, the lower shutter portion 106 is integrally formed with an actuating plate 108 in a single injection molding process. In other words, the lower shutter portion 106 is made as a single integral piece with the actuating plate 108. The actuating plate 108 of the lower shutter portion 106 includes a coupler 122 for coupling the actuator shaft 20 as shown in FIG. 1. Similar to the first embodiment, the actuating shaft 20 is pivotally connected to the coupler 122 using any suitable method, such as pins, fasteners, etc.

Figure 16:
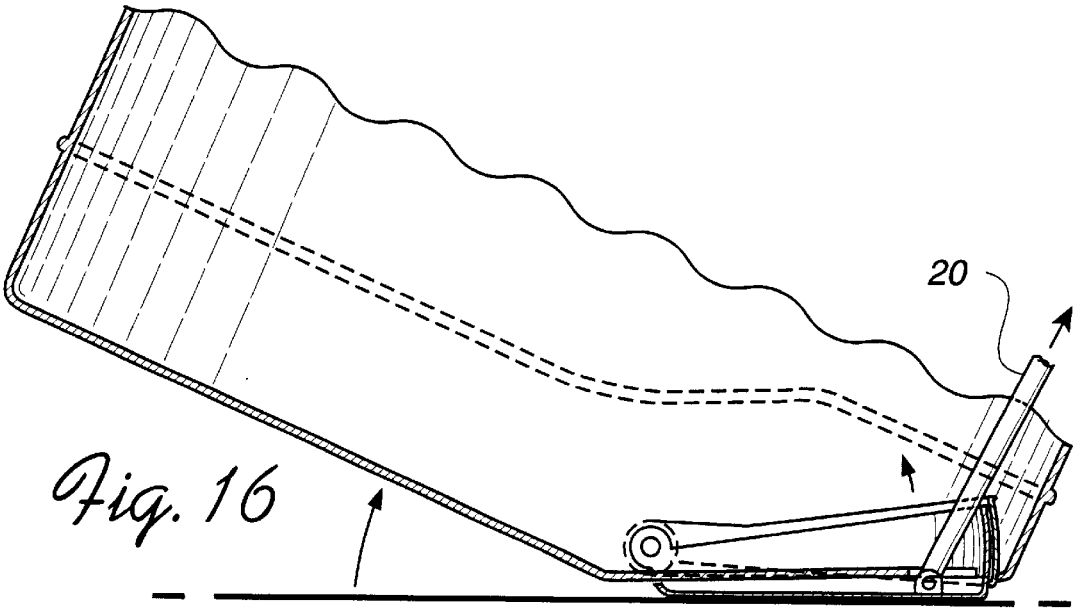
FIG. 16 is a partial sectional view showing the bottom portion of the golf bag of FIG. 13 when the golf bag is in the leaning position.

FIG. 16 is a partial sectional view showing the bottom portion of the golf bag of FIG. 13 when the golf bag is in the leaning position. As shown, when the golf bag is leaning toward the ground, the upper and lower shutter portions 104 and 106 are collapsed with respect to each other to allow the actuating shaft 20 to be pushed longitudinally upward to extend the legs 16.

Figure 17:
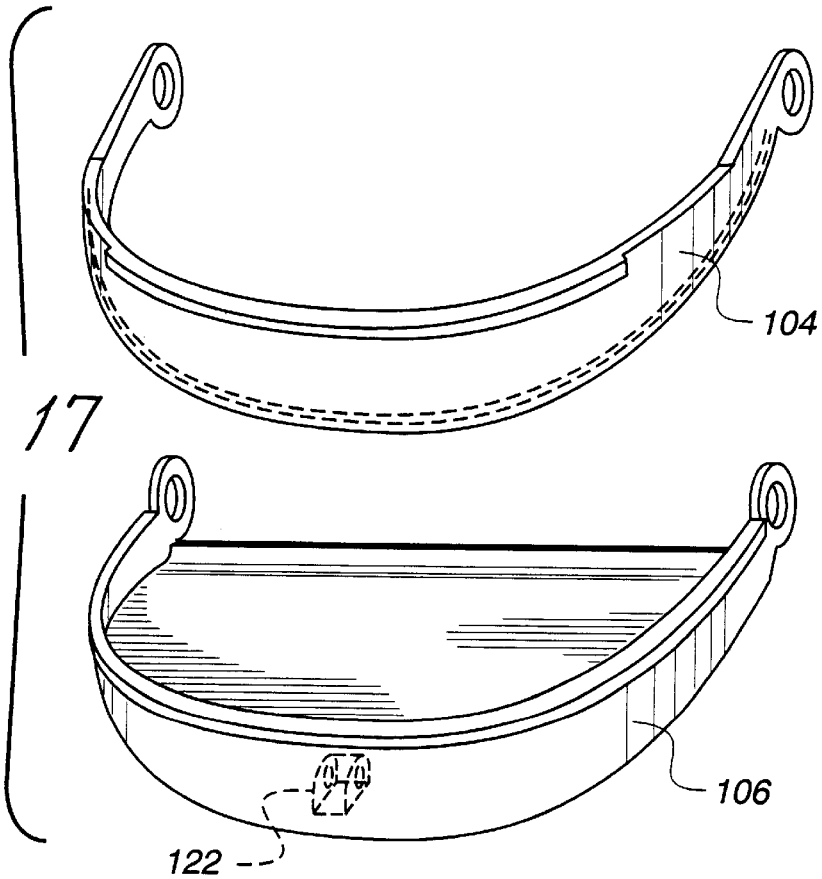
FIG. 17 is a disassembled view of the collapsible shutter of FIG. 15.

FIG. 17 is an exploded view showing the collapsible shutter assembly of FIG. 15. The upper shutter portion 104 and the lower shutter portion 106 are similarly configured to have a substantially semi-circular shape. As described above, the curvature radius of the upper shutter portion 104 is slightly larger than that of the lower shutter portion 106 to allow the upper shutter portion 104 to fit around the lower shutter portion 106 while allowing both shutters to move vertically with respect to each other.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A golf bag comprising:

a body having a side surface and a bottom end, the body defining a longitudinal axis;

at least one leg pivotally connected to the body and being able to pivot between a retracted position where the leg is disposed substantially longitudinally along the side surface of the body and an extended position where lower end of the leg is spaced apart from the body;

an actuator member disposed substantially longitudinally along the side surface of the body and longitudinally moveable relative to the body, the actuator member being connected at an upper portion to the leg so that the longitudinal motion of the actuator shaft effects the pivoting motion of the leg;

a base member disposed at the bottom end of the body, the base member having a bottom face substantially perpendicular to the longitudinal axis of the body and a slanted face extending from the bottom face at an angle therewith to define a cutout region;

an actuator plate pivotally connected to the base member, the actuator plate being able to pivot between a first position and a second position, wherein the lower end of actuator member is connected to the actuator plate so that the actuator shaft moves longitudinally when the actuator plate pivots between the first and the second position; and a shutter assembly slidably attached to the base member and to the actuator plate to at least partially enclose the cutout region defined by the base member, wherein the shutter assembly comprises upper and lower shutter portions which are slidably coupled to each other and pivotally connected to the base member, the lower shutter portion being integrally attached to the actuator plate, so that when the actuator plate is at the second position the upper and the lower shutter portions are collapsed.

2. The golf bag of claim 1, wherein the shutter assembly substantially enclose the cutout region defined by the base member.

3. The golf bag of claim 1, wherein each of the upper and the lower shutter portions is substantially of a U-shape.

4. The golf bag of claim 1, wherein a lower portion of the actuator member is partially hidden from view to engage the actuator plate.

5. The golf bag of claim 1, wherein the actuator member is a U-shaped actuating rod, a bottom end of the actuating rod being connected to the actuator plate and a top end being pivotally connected to the leg.

6. A base member used for a golf bag having a body with a side surface and a bottom end, the body defining a longitudinal axis; legs pivotally connected to the body and being able to pivot between a retracted position where the legs are disposed substantially longitudinally along the side surface of the body and an extended position where lower ends of the legs are spaced apart from the body; an actuator member disposed substantially longitudinally along the side surface of the body and longitudinally moveable relative to the body, the actuator member being connected at an upper portion to the legs so that the longitudinal motion of the actuator shaft effects the pivoting motion of the legs, the base member comprising:

a tubular base body member disposed at the bottom end of the body, the base body member having a bottom face substantially perpendicular to the longitudinal axis of the body and a slanted face extending from the bottom face at an angle therewith to define a cutout region;

an actuator plate pivotally connected to the base body member, the actuator plate being able to pivot between a first position and a second position, wherein the lower end of actuator member is connected to the actuator plate so that the actuator shaft moves longitudinally when the actuator plate pivots between the first and the second position; and a shutter assembly slidably attached to the base body member and to the actuator plate to at least partially enclose the cutout region defined by the base body member, wherein the shutter assembly comprises upper and lower shutter portions which are slidably coupled to each other and pivotally connected to the base member, the lower shutter portion being integrally attached to the actuator plate, so that when the actuator plate is at the second position the upper and the lower shutter portions are collapsed.

7. The base member of claim 6, wherein the shutter assembly substantially enclose the cutout region defined by the base member.

8. The base member of claim 6, wherein each of the upper and the lower shutter portions is substantially of a U-shape.

9. A golf bag comprising:

a body having a side surface and a bottom end;

two legs pivotally connected to the body and being able to pivot between a retracted position where the legs are disposed substantially longitudinally along the side surface of the body and an extended position where lower ends of the legs are spaced apart from the body;

an actuator disposed substantially longitudinally along the side surface of the body and longitudinally moveable relative to the body, a lower portion of the actuator being disposed inside the body, the actuator being connected at an upper portion to the legs so that the substantially longitudinal motion of the actuator causes the pivoting motion of the legs;

a base member disposed at the bottom end of the body, the base member having a bottom face to be placed flush against a hard surface and a slanted face extending from the bottom face at an angle therewith to define a cutout region; and a cover attached to the base member to at least partially cover the cutout region defined by the base member.

10. The golf bag of claim 9, further comprising:

an actuator plate disposed within the cutout region defined by the base member and pivotally connected thereto, the actuator plate being able to pivot between a first position where it is disposed within the plane of the bottom face of the base member, and a second position where it is disposed near the slanted face, wherein the lower end of the actuator is connected to the actuator plate so that the actuator moves longitudinally when the actuator plate pivots between the first and the second position.

11. The golf bag of claim 9, wherein the lower end of the actuator is disposed inside the body.

12. The golf bag of claim 11, wherein the body defines a through hole in a lower portion of the body and the lower end of the actuator is connected to the actuating plate through the through hole.

13. The golf bag of claim 9, wherein the cover is made of a resilient material and tends to urge the actuator plate to pivot to its first position.

14. The golf bag of claim 9, wherein the cover is compressed when the actuator plate is in the second position.

15. The golf bag of claim 11, wherein the cover is made of a resilient material and tends to urge the actuator plate to pivot to its first position.

16. The golf bag of claim 10, wherein the lower end of the actuator is disposed inside the body.

17. The golf bag of claim 16, wherein the body defines a through hole in a lower portion of the body and the lower end of the actuator shaft is connected to the actuating plate through the through hole.

18. The golf bag of claim 16, wherein the cover is made of a resilient material and tends to urge the actuator plate to pivot to its first position.

* * * * *